United States Patent [19]

Miller

[11] Patent Number: 4,673,337

[45] Date of Patent: Jun. 16, 1987

[54] HYDRAULIC RADIAL PISTON PUMP INTAKE PORTING ARRANGEMENT

[75] Inventor: Gary T. Miller, Amherst, N.Y.

[73] Assignee: General Motors Corporation, Detroit, Mich.

[21] Appl. No.: 802,587

[22] Filed: Nov. 27, 1985

[51] Int. Cl.[4] ..... F01B 13/06; F04B 1/04

[52] U.S. Cl. ..... 417/273; 91/490

[58] Field of Search ..... 91/493–496, 91/490; 417/270, 273; 74/DIG. 10

[56] References Cited

U.S. PATENT DOCUMENTS

| | | | |
|---|---|---|---|
| 1,904,653 | 4/1933 | Davis et al. | 91/494 |
| 2,324,291 | 7/1943 | Dodge | 417/273 |
| 2,962,974 | 12/1960 | Porkert | 74/DIG. 10 |
| 3,125,034 | 3/1964 | Lucien et al. | 91/490 |
| 3,160,073 | 12/1964 | Lucien et al. | 91/481 |
| 3,450,058 | 6/1969 | Stein | 92/71 |

FOREIGN PATENT DOCUMENTS

| | | | |
|---|---|---|---|
| 3039197 | 5/1982 | Fed. Rep. of Germany | 417/273 |
| 453106 | 6/1982 | U.S.S.R. | 417/273 |

*Primary Examiner*—Leonard E. Smith

*Attorney, Agent, or Firm*—R. L. Phillips

[57] ABSTRACT

A hydraulic radial piston pump has intake porting comprising a slot in the face of a slider block communicating with a passage extending axially through the piston.

3 Claims, 6 Drawing Figures

HYDRAULIC RADIAL PISTON PUMP INTAKE PORTING ARRANGEMENT

TECHNICAL FIELD

This invention relates to hydraulic radial piston pumps and more particularly to their intake porting arrangement.

BACKGROUND OF THE INVENTION

In hydraulic radial piston pumps employing the piston as a valve to open and close an intake port in the cylinder wall, hydraulic shock can occur as the piston moving at high speed covers the intake port. Furthermore, the piston and cylinder bore dimensions must be held closely to effectively seal this port. And piston rings are not recommended as they would be subjected to excessive wear as they cross the port. Moreover, displacement is lost as no compression can be attained while the intake port is open.

SUMMARY OF THE INVENTION

In those radial piston pumps where the piston(s) is driven by a shaft eccentric through a slider block, it has been discovered that the intake port can be eliminated from the cylinder wall thus avoiding all the problems attendant therewith. Normally, the slider block rides on the eccentric and bears against a pad on the piston to force the piston through its compression stroke. Piston retraction on the other hand is accomplished by a yoke which may be utilized to also retain other pistons on the slider block. During such displacement of the piston, the slider block slides across the piston's pad and this feature is utilized in eliminating the intake port from the cylinder wall. Instead of an intake port in the cylinder wall, there is now formed an intake slot in the slider block that is in continuous communication with the liquid to be pumped and is located to communicate with an intake passage extending through the piston pad to the working end of the piston. The intake slot is arranged so as to be open to the intake passage during the intake stroke while the slider block is sliding across the piston's pad. The length of the slot is determined so that near the completion of the intake stroke just prior to the beginning of the compression stroke the slot has with the continuing slider block movement moved out of communication with the intake passage and the latter is now closed by an unslotted portion of the slider block surface as the piston continues to be driven on its compression stroke. The force of compression maintains the piston pad face tightly against the sliding slider block face effectively sealing the piston's intake passage as the compression stroke continues. At the completion of compression, the slider block reverses direction and again brings the intake slot in its face into communication with the intake passage in the piston pad face as the piston is retracted by the yoke to perform its intake stroke thus completing the pumping cycle.

With the above new intake porting arrangement of the slot in the slider block face and the passage extending through the piston from the pad face, there results several major improvements in performance and manufacturing. For example, hydraulic hammer or port shock is eliminated with the piston being sealed prior to compression resulting in smoother and quieter pump operation. In addition, piston rings can be used as there is no cylinder wall port opening that would cause excessive wear. This also eliminates the need for critical piston and cylinder bore tolerances thus simplifying manufacturing and any requirement for selective fit of the parts. Moreover, the pump's effective displacement is increased by the elimination of the intake port from the cylinder wall and its associated losses. This improves the pump efficiency and thus the output and enables downsizing. And preferably, both the slider block and yoke are plastic parts molded from acetal resin and thus have lower friction and further reduce the cost as compared with the machined metal parts commonly used.

These and other objects, advantages and features of the present invention will become more apparent from the following description and drawing in which:

DESCRIPTION OF THE ACCOMPANYING DRAWING

Figure 1:
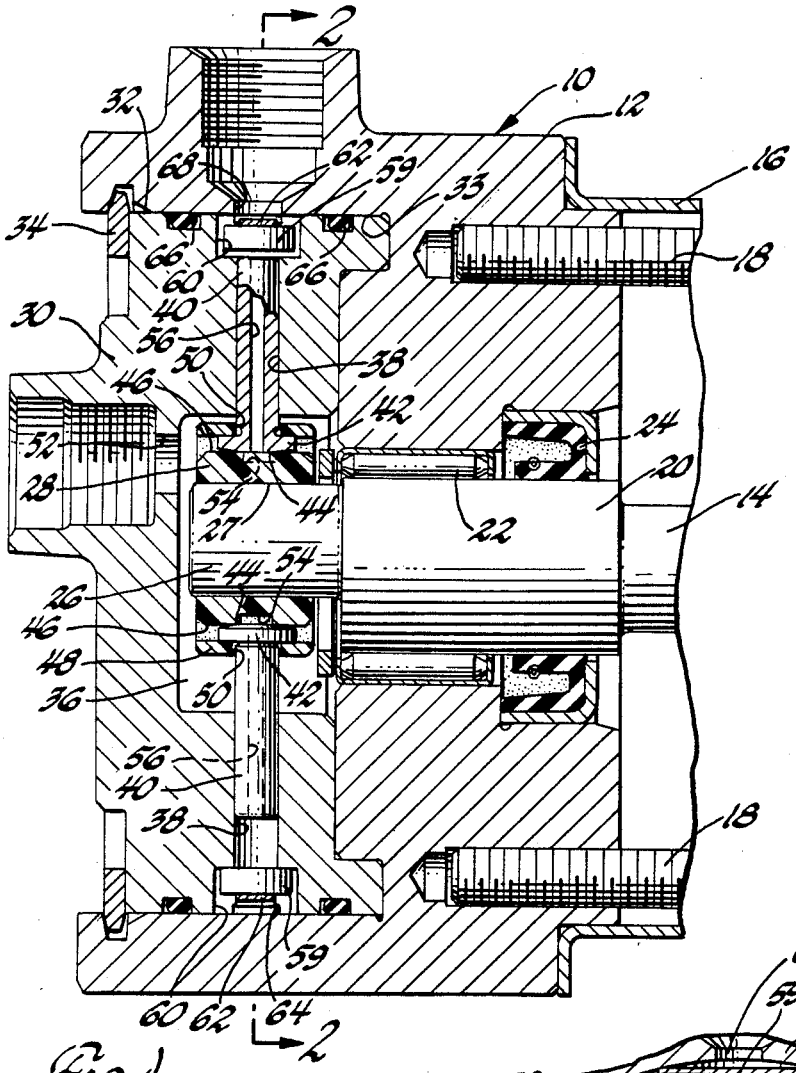
FIG. 1 is a longitudinal sectional view of the preferred embodiment of the hydraulic pump with improved intake porting according to the present invention.
Figure 2:
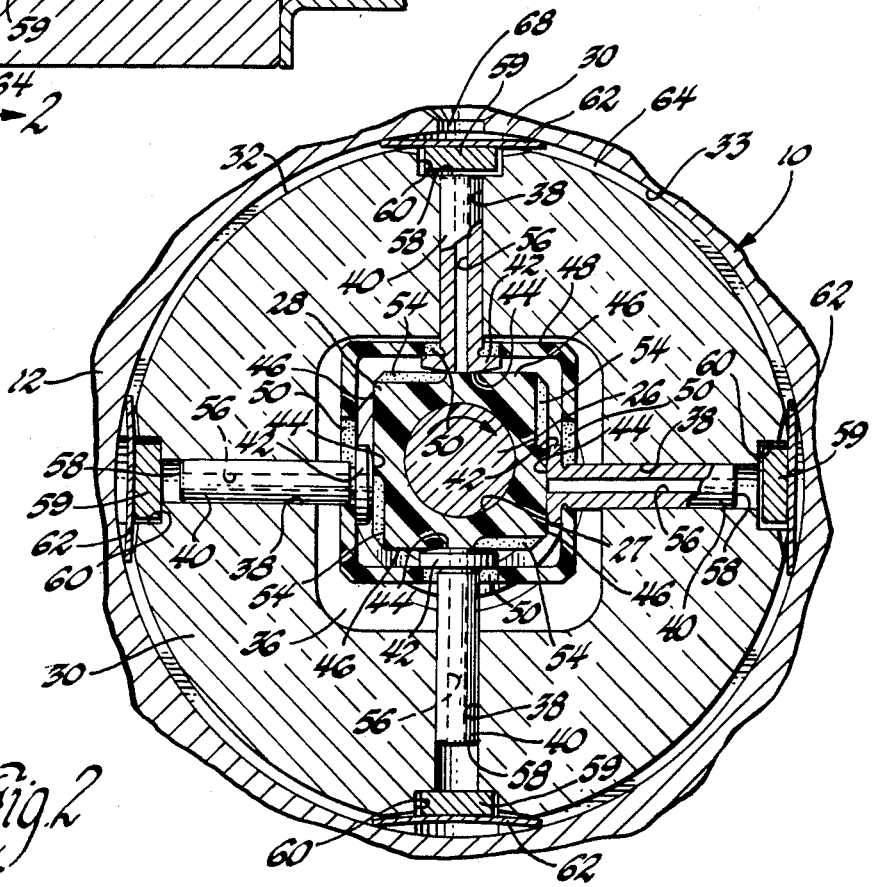
FIG. 2 is a sectional view taken along the line 2—2 in FIG. 1.

Referring to FIGS. 1 and 2, the hydraulic pump generally designated as 10 comprises a housing 12 centrally supporting a drive shaft 14 that is powered by a motor 16 (only partially shown) secured to the housing by bolts 18. The shaft has an enlarged diameter portion 20 by which it is supported in the housing with a needle bearing assembly 22 and sealed with a shaft seal assembly 24 press-fitted in the housing between the bearing and the motor. The shaft has an eccentric cylindrical portion 26 adjoining the enlarged diameter portion that overhangs the housing and is received in a central bore 27 of a slider block 28 that is enclosed by a cylinder block 30. The cylinder block has a cylindrical periphery 32 by which it fits in an end bore 33 in the housing. The cylinder block is retained by a snap ring 34 and has a centrally located cavity 36 in its inner face that receives the slider block.

The cylinder block has four radially extending cylinders or bores 38 that open to the cavity 36 and are equally spaced at 90° apart about the shaft axis at a common axial position with one cylinder thus diametrically opposite another. A piston 40 is slidably mounted in each cylinder and extends at its inner end into the cavity 36. The inner end of each piston has an enlarged diameter pad portion 42 on which is formed a face 44 that contacts with one of the four equal flat side faces 46 of the slider block.

Figure 5:
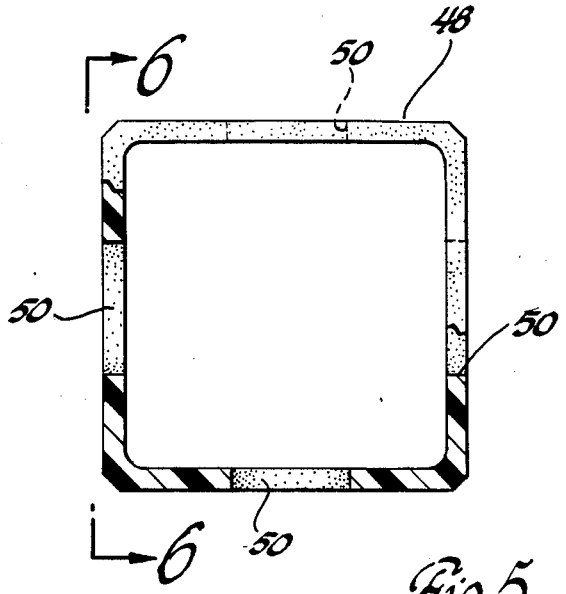
FIG. 5 is an enlarged end view with a portion broken away of the yoke in FIG. 2.
Figure 6:
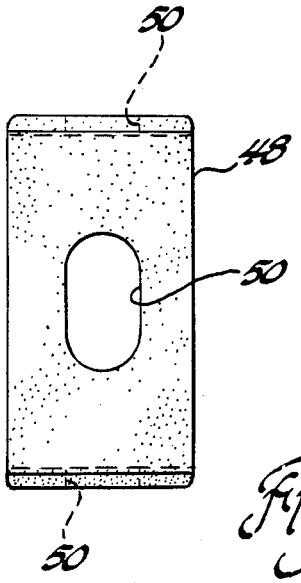
FIG. 6 is a side view taken along the line 6—6 in FIG. 5.

A four-sided yoke 48 fits about the slider block in the cavity and has a slot 50 in each side through which the associated piston extends (see FIGS. 5 and 6 as well as FIGS. 1 and 2). The inner sides of the yoke contact with the backside of the associated piston pads 42 and their relative dimensions are determined so that the yoke remains stationary relative to the slider block and serves to retract the pistons keeping their pads all close to the respective slider block side faces while the slider block is forced to reciprocate without turning relative to the cavity walls on rotation of the pump shaft. The yoke slots 50 are elongated perpendicular to the shaft so as to permit the accompanying movement of the yoke relative to the pistons as the slider block side faces 46 slide along the piston pad faces 44 on rotation of the pump shaft with those slider block side faces moving away from the shaft axis forcing the associated pistons radially outward on a compression stroke and those yoke sides at the slider block side faces moving toward the shaft axis forcing the associated pistons radially inward on an intake or suction stroke.

Hydraulic fluid such as oil is supplied to the pump through a delivery port 52 in the cylinder block 30 to the cavity 36 and continuously fills same during pumping operation. Intake porting for porting this oil in the cavity to the working ends of the cylinders during their piston's intake stroke is provided by an identical slot 54 in each of the slider block side faces 46. The intake slots extend from a trailing edge of the slider block as viewed in the direction of slider block movement and are always open at and adjacent this end to the surrounding cavity. The other end of the intake slot extends into the area where the slider block normally contacts with the associated piston pad face but only for a certain distance as seen in FIG. 2. In addition, each of the pistons is formed with a central intake passage 56 extending axially therethrough from the respective pad face 44 to the piston's working end 58. Opposite the working end of each piston, there is located a check valve 59 in the form of a disk. The check valve is mounted with substantial side clearance in a counterbore 60 in the outer end of each cylinder and is biased radially inward by a leaf spring 62 that is retained in an annular discharge passage 64 extending about the cylinder block periphery 32. The discharge passage 64 is open to the counterbore 60 of all the cylinders 38 and is defined by the periphery 32 and the housing end bore 33 and is sealed by a pair of 0-rings 66 received in grooves in the cylinder block periphery. The check valves are thus spring biased to close their respective cylinders during the intake stroke and open against this spring force to allow the oil to flow therepast to the annular passage which opens to a single discharge port 68 through the housing to deliver the pumped oil to the system being served.

The length of the intake slots is determined so that near the completion of their associated piston's intake stroke just prior to the beginning of the compression stroke, the respective slots with the continuing slider block movement move therewith out of communication with the associated piston intake passage so that the latter is then closed by the otherwise normal unslotted portion of the slider block face as the piston continues on its compression stroke. And the force of compression maintains the piston pad face tight against the sliding slider block face effectively sealing the intake port as the compression stroke continues. At the completion of compression, the slider block reverses direction and again brings the intake slot in its face into communication with the intake passage in the piston pad face as the piston is retracted by the yoke to perform its intake stroke thus completing the pumping cycle. For example, the piston in the 12 o'clock position in FIG. 2 has reached full compression with the hollow pad sealed against the solid or unslotted portion of the associated slider block face. As the slider block moves to the right and down, this piston will retract and the associated intake slot will be under the piston's intake passage allowing fluid to flow into the bore. This is shown by the piston in the 9 o'clock position. The piston at 6 o'clock has just completed intake and left the slotted portion of the slider block. As the slider block moves to the right and downward, this piston is sealed on the solid face of the slider block while being driven into the cylinder. This is shown by the piston in the 3 o'clock position.

Figure 3:
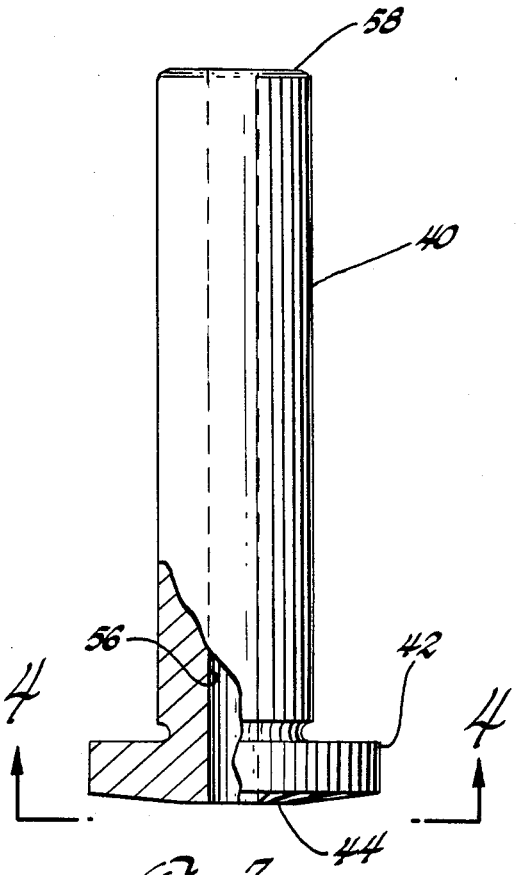
FIG. 3 is an enlarged side view of one of the pistons in FIG. 1.
Figure 4:
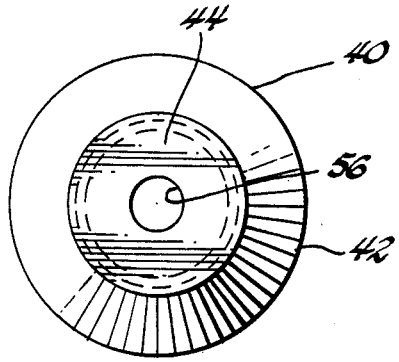
FIG. 4 is an end view taken along the line 4—4 in FIG. 3.

Preferably, the piston pad faces are chamfered as best seen in FIGS. 3 and 4 so that the annular pad face area is equal to that of the annular working piston area 58 at the opposite piston. This prevents a fluid film from developing between the slider block and pad which would tend to lift the piston off the block during compression breaking the seal.

In addition, both the slider block and the yoke are preferably plastic molded parts molded of acetyl resin having low friction as compared with metal. Moreover, the yoke is preferably a one-piece design rather than the normal two yoke arrangement.

The above described embodiment is illustrative of the invention which may be modified within the scope of the appended claims.

The embodiments of the invention in which an exclusive property or privilege is claimed are defined as follows:

1. A hydraulic radial piston pump having a slider block mounted on an eccentric of a rotary shaft in a hydraulic fluid supplied cavity, a piston mounted in a cylinder disposed radially to the shaft, the piston having a flat working face at one end operating in the cylinder and a flat pad at an opposite end slidably engaged by a flat face of the slider block so as to force the piston outward on a compression stroke on shaft rotation, a yoke retaining the piston to the slider block so as to retract the piston inward on an intake stroke on shaft rotation characterized by intake porting means for communicating the cavity with the working end of the piston comprising an intake passage extending centrally and axially through the piston from the working end to the pad end resulting in an annular face at both piston ends, an elongated intake slot in the face of the slider block extending from a point continuously open to the cavity to a point that opens to the intake passage at the pad end on relative movement of the slider block during the intake stroke to just prior to the compression stroke, and the annular faces at the working and pad ends of the piston having substantially equal areas to prevent hydraulic film from developing between the slider block and pad and thereby prevent their separation during compression.

2. A hydraulic radial piston pump having a slider block mounted on an eccentric of a rotary shaft in a hydraulic fluid supplied cavity, a piston mounted in a cylinder disposed radially to the shaft, the piston having a flat working face at one end operating in the cylinder and a flat pad at an opposite end slidably engaged by a flat face of the slider block so as to force the piston outward on a compression stroke on shaft rotation, a yoke retaining the piston to the slider block so as to retract the piston inward on an intake stroke on shaft rotation characterized by intake porting means for communicating the cavity with the working end of the piston comprising an intake passage extending through the piston from the working end to the pad end, an elongated intake slot in the face of the slider block extending from a point continuously open to the cavity to a point that opens to the intake passage at the pad end on relative movement of the slider block during the intake stroke to just prior to the compression stroke, the annular faces at the working and pad ends of the piston having substantially equal areas to prevent hydraulic film from developing between the slider block and pad and thereby prevent their separation during compression, and the yoke being a one-piece four-sided part that fits over the slider block and has a slot through which the piston extends and is engaged on opposite sides by the piston pad to retract the piston.

3. A hydraulic radial piston pump having a slider block mounted on an eccentric of a rotary shaft in a hydraulic fluid supplied cavity, a piston mounted in a cylinder disposed radially to the shaft, the piston having a flat working face at one end operating in the cylinder and a flat pad at an opposite end slidably engaged by a face of the slider block so as to force the piston outward on a compression stroke on shaft rotation, a yoke retaining the piston to the slider block so as to retract the piston inward on an intake stroke on shaft rotation characterized by intake porting means for communicating the cavity with the working end of the piston comprising an intake passage extending through the piston from the working end to the pad end, an elongated intake slot in the face of the slider block extending from a point continuously open to the cavity to a point that opens to the intake passasge at the pad end on relative movement of the slider block during the intake stroke to just prior to the compression stroke, the annular faces at the working and pad ends of the piston having substantially equal areas to prevent hydraulic film from developing between the slider block and pad and thereby prevent their separation during compression, and both the slider block and yoke being a one-piece plastic molded part.

* * * * *